United States Patent [19]

Kern et al.

[11] Patent Number: 4,769,775

[45] **Date of Patent: * Sep. 6, 1988**

[54] MICROPROCESSOR-CONTROLLED FIRE SENSOR

[75] Inventors: Mark T. Kern, Goleta; Robert J. Cinzori, Santa Barbara, both of Calif.

[73] Assignee: Santa Barbara Research Center, Goleta, Calif.

[ * ] Notice: The portion of the term of this patent subsequent to Jul. 7, 2004 has been disclaimed.

[21] Appl. No.: 265,764

[22] Filed: May 21, 1981

[51] Int. Cl.[4] ..... G08B 17/12; G08B 29/00

[52] U.S. Cl. ..... 364/551.01; 340/578; 340/600

[58] Field of Search ..... 364/400, 550, 551; 340/577, 578, 600; 371/16, 20; 116/5, 101

[56] References Cited

U.S. PATENT DOCUMENTS

| | | | |
|---|---|---|---|
| 3,967,255 | 6/1976 | Oliver et al. | 340/578 |
| 4,122,996 | 10/1978 | Wilczek | 371/20 |
| 4,200,224 | 4/1980 | Flint | 371/16 |
| 4,245,309 | 1/1981 | Kiefer | 371/20 |
| 4,280,184 | 7/1981 | Weiner et al. | 340/578 |

FOREIGN PATENT DOCUMENTS

| | | | |
|---|---|---|---|
| 2907546 | 11/1979 | Fed. Rep. of Germany | 340/578 |

*Primary Examiner*—Gary Chin

*Attorney, Agent, or Firm*—W. C. Schubert; V. G. Laslo; A. W. Karambelas

[57] ABSTRACT

A fire sensor can perform a sophisticated analysis of the outputs of radiant energy detectors, while minimizing size, weight, and cost, by employing a microprocessor to analyze the detector outputs. In a preferred embodiment, an Intel 2920 Signal Processor is utilized as the microprocessor.

16 Claims, 1 Drawing Sheet

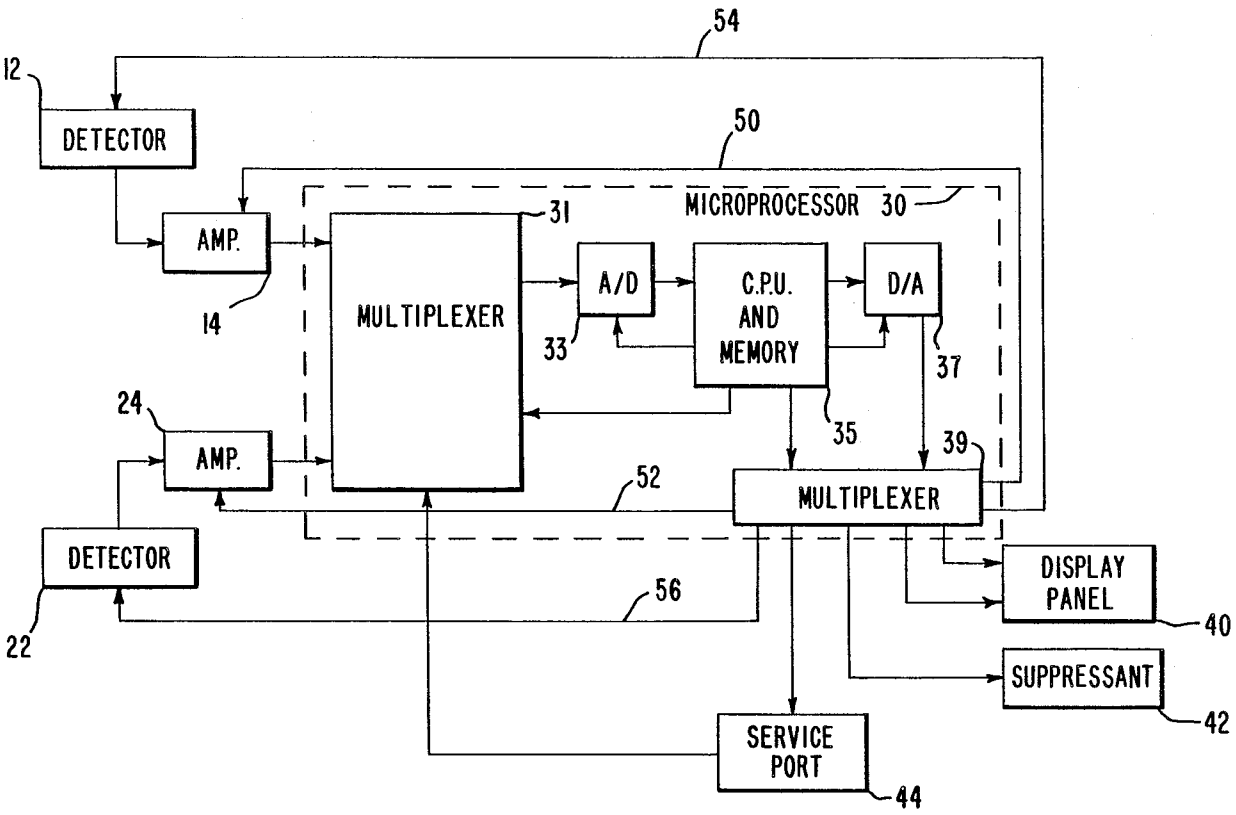
DETECTOR
12
54
AMP.
14
MICROPROCESSOR 30
50
MULTIPLEXER
31
A/D
33
C.P.U. AND MEMORY
35
D/A
37
MULTIPLEXER
39
52
AMP.
24
DETECTOR
22
56
DISPLAY PANEL
40
SUPPRESSANT
42
SERVICE PORT
44

MICROPROCESSOR-CONTROLLED FIRE SENSOR

BACKGROUND OF THE INVENTION

1. Field of the Invention

This invention relates to the field of fire sensors generally, and in particular, to fire sensors using microprocrssors instead of discrete analog circuits to determine whether a fire exists.

2. Description of the Prior Art

There presently exists many techniques for sensing the presence of fires or explosions within a protected area, and for discriminating against other phenomena that create false alarms. Some examples of phenomena which fire sensors seek to discriminate against include sunlight, small fires, explosions which do not cause a fire, and the flash created by a projectile piercing a wall of the protected area. All previous discrimination techniques use various combinations of spectral selection and various comparisons between the sensed energy of the various spectral regions. Prior art discrimination techniques have employed discrete analog circuitry, such as op-amps and comparators, in conjunction with a few digital gates. Such discrimination circuits have been kept intentionally simple because the fire sensor packages must remain small and light to be useful. Complex circuitry also increases the selling price of the fire sensor. It would be advantageous to obtain a fire sensor that is light, small, and inexpensive while still being able to perform relatively complex analysis of the radiation sensed. It would also be desirable to realize the discrimination circuitry in a form wherein the discrimination techniques could be readily changed without discarding or changing the actual hardware. Such advantages have not been obtainable with prior art fire sensors.

SUMMARY OF THE INVENTION

It is a purpose of this invention to provide a new and improved fire sensor which overcomes the above-described disadvantages of the prior art fire sensors, and which is operable to detect the presence of a fire and cause the release of a fire suppressant.

It is also a purpose of this invention to provide a new and improved fire sensor that is relatively small, light, and inexpensive while still being able to perform relatively complex analysis of the radiation it senses.

It is a further purpose of this invention to provide a new and improved fire sensor having discrimination circuitry that is programmable, so that analysis of the radiation sensed can be changed without altering the discrimination hardware.

To accomplish these purposes while overcoming the disadvantages of the prior art described above, the present invention provides a fire sensor system having one or more detector means in combination with an integrated circuit microprocessor.

BRIEF DESCRIPTION OF THE DRAWING

FIG. 1 is a block diagram of a fire sensor system according to a preferred embodiment of this invention.

DETAILED DESCRIPTION OF THE INVENTION

A microprocessor-controlled fire sensor according to the present invention is shown in FIG. 1. The fire sensor has two detector channels each having one detector capable of sensing electromagnetic energy from a radiation source 10 having a wavelength within a certain spectral band. Typically, a first detector 12 is capable of sensing only radiation having a wavelength of from 0.7 microns to 2.0 microns, and a second detector 22 is capable of sensing radiation in the 5 to 30 micron spectral region. Since the output amplitudes of the optical detectors 12 and 22 are usually too small to be fed directly to a microprocessor, the detector outputs are amplified by analog amplifiers 14 and 24, respectively, and fed to a microprocessor 30. The detector 12 is a commercially available silicon photodiode, and the detector 22 is a radiation thermopile. The amplifiers 14 and 24 are commercially available operational amplifiers. The microprocessor 30 in the preferred embodiment is a Model 2920 Signal Processor, made by Intel, Inc. of Santa Clara, Calif. Of course, depending upon the particular application, other microprocessors may be substituted for the Intel 2920. The Intel 2920 Signal Processor is described in detail in the 1980 Intel Component Catalog, published by Intel, Inc., pages 4–43 to 4–50.

A simplified block diagram of the Intel 2920 is shown within the dotted lines in FIG. 1. The amplified inputs from the detectors 12 and 22 are fed to an input multiplexer 31. The input multiplexer 31 chooses one of the input signals and transmits it to an analog-to-digital (A/D) converter 33, where the analog signal is converted to a digital signal. That digital signal is fed to a central processing unit (CPU) 35 while the input multiplexer 31 feeds the other input signal to the A/D converter 33. The other input signal is convert to digital form and fed to the CPU 35 in the same manner.

The input multiplexer 31 samples each of the amplified analog signals from the detectors 12 and 22, one at a time, feeding each sampled signal individually to the A/D converter 33 and thereby to the CPU 35. When each digitalized sample of information reaches the CPU 35, it is operated on in the manner programmed into the microprocessor 30. The microprocessor 30 can be programmed and reprogrammed to perform various routines on the detected information without altering the hardware of the system.

When the CPU 35 reaches a decision based on the input information, digital commands are converted to analog signals via a digital-to-analog (D/A) converter 37. The command signal directs the output demultiplexer 39 to feed the analog command signal to the proper output circuit. For instance, if the CPU 35 determines that the detectors have sensed a small fire that does not require use of the suppressant, the analog command signal may be fed to a display panel 40 where it will activate a "small fire" indicator (not shown). If, however, the CPU 35 determines that there is a dangerous fire or explosion occurring, the output demultiplexer 39 will feed the command signal to a suppressant circuit 42 that will release a fire suppressant.

The input and output multiplexers 31 and 39, the A/D converter 33, and the D/A converter 37 are all controlled by the CPU 35. Likewise, the detector amplifiers 14 and 24 are controlled by the CPU 35 through the output demultiplexer 39. If the amplified detector signals saturate, or exceed the microprocessor's input signal range, the CPU 35 will order the output demultiplexer 39 to reduce the gain of the amplifiers 14 and 24 via feedback lines 50 and 52. The CPU program will then compensate for the reduced analog gain by processing the resulting digital information with an appropriate scale factor.

The CPU 35 can also be programmed to check itself periodically. The CPU 35 will command the output demultiplexer 39 to stimulate the detectors 12 and 22 with various test conditions via feedback lines 54 and 56. If the signals coming back to the CPU 35 are of the proper amplitude and timing, and the self-check routine indicates that the CPU 35 has itself followed the appropriate steps in processing the data, an output will be generated and sent to an indicator on the display panel 40 to indicate that all is well. If something is found to be wrong during the test routine, the CPU 35 can be commanded to perform a diagnostic test routine from a service port 44 to isolate the faulty component. The self-check routine may be supplied automatically and periodically by the CPU 35 by an appropriate program of the CPU 35. The automatic check program would have to include a provision that the check routine would not be initiated if the signal from either amplifier 14 or amplifier 24 were greater than a predetermined value, so that a check routine would not be initiated just as a real fire was developing.

The result of the microprocessor sampling of each input and operating on successive samples according to the program software is a fairly sophisticated waveform analysis. The microprocessor 30 can, for example, be programmed to detect a small flickering fire and indicate that fact. If the fire becomes dangerous, the microprocessor 30 will automatically cause a suppressant to be released. The microprocessor 30 can also recognize the flash of a projectile striking within the field of view and "watch" it decay. If the projectile starts a fire, the microprocessor 30 will analyze the fact that the detected flash is not decaying as expected and cause suppressant to be released.

It is understood that the above-described embodiment is merely illustrative of the many possible specific embodiments which can represent applications of the principles of this invention. Numerous and varied other arrangements can be devised in accordance with these principles by those skilled in this art without departing from the spirit and scope of the invention.

What is claimed is:

1. A fire sensor system comprising:

at least one detector means for detecting electromagnetic energy and generating a detector signal responsive to the amplitude of the detected energy;

microprocessor means for analyzing each detector signal and generating an output signal in response to certain predetermined patterns in the particular detector signal, amplifier means disposed between each detector means and the microprocessor means; and wherein the microprocessor means further includes means for controlling the gain of each amplifier and means for stimulating each detector with at least one test stimulus.

2. The fire sensor system of claim 1 wherein said at least one detector means comprises a first detector means for sensing energy having a wavelength within a first spectral band and a second detector means for sensing energy having a wavelength within a different second spectral band.

3. The fire sensor system of claim 2 wherein the first spectral band is from 0.7 microns to 2.0 microns and the second spectral band is from 5 microns to 30 microns.

4. The fire sensor system of claim 1 further comprising diagnostic means, within the microprocessor means, for performing a diagnostic check routine.

5. The fire sensor system of claims, 1, 2, 3, or 4 wherein the microprocessor means is an Intel 2920 Signal Processor.

6. The fire sensor system of claim 4 wherein the diagnostic means automatically and periodically implements the diagnostic check routine, except when the signal from any detector is above a certain predetermined value.

7. The fire sensor system of claim 4 wherein at least one of the detector means is remotely disposed from the microprocessor means.

8. A system for selectively releasing a fire suppressant, said system comprising:

a selectively releasable source of fire suppressant;

first detector means for generating an output signal in response to detected electromagnetic energy associated with fire-related conditions;

microprocessor means for operating on data applied to its inputs and generating commands in response thereto at its outputs, said microprocessor means including a central processing unit (CPU) and a programmable random access memory;

first coupling means for coupling the first detector means to an input of the microprocessor means;

second coupling means for coupling an output of the microprocessor means to the source of fire suppressant; and said memory having a program stored therein for causing said CPU to analyze the output signal from the first detector means and generate a command to said source causing said fire suppressant to be released when the detector signal exhibits preprogrammed characteristics indicative of a serious fire.

9. The system of claim 8 which further includes display means for providing a visual display of information; and wherein the program in the memory is adapted to refrain from releasing the suppressant yet provide a visual warning on the display means when said preprogrammed characteristics indicate the presence of a small flickering fire.

10. The system of claim 8 wherein said program in the memory is adapted to monitor the rate of decay of a flash of light associated with a projectile striking an object within the field of view of the first detector means, with the CPU causing said suppressant to be released if the rate of decay fails to follow preprogrammed criteria.

11. The system of claim 8 which further comprises:

second detector means for generating a second output signal in response to detected electromagnetic energy in a different spectral band than the first detector means.

12. The system of claim 11 wherein said first detector means is responsive to electromagnetic energy in a first spectral band having wavelengths between 0.7 microns and 2.0 microns, with the second detector means responding to electromagnetic energy in a second spectral band having wavelengths between 5 microns and 30 microns.

13. The system of claim 8 wherein said first coupling means includes a variable gain amplifier; and wherein an output from the microprocessor means is used to control the gain of said amplifier.

14. The system of claim 11 which further comprises:

a multiplexer having inputs coupled to the first and second detector means, said multiplexer having an output;

an analog-to-digital converter having an input coupled to an output of the multiplexer, said converter having an output connected to the CPU whereby said multiplexer can sample the output signals from each detector which are then individually fed to the converter and then to an input of the CPU.

15. The system of claim 8 wherein said program in the memory is adapted to provide periodic self-check routines wherein at least said first detector means is stimulated to determine if it is operating properly.

16. The system of claim 15 wherein said system further comprises:

means for inhibiting the self-check routine when an output signal from said first detector means is greater than a predetermined value.

* * * * *